US009695371B2

(12) United States Patent
Hannemann et al.

(10) Patent No.: US 9,695,371 B2
(45) Date of Patent: Jul. 4, 2017

(54) COOLING AND SCRUBBING OF A CRUDE GAS FROM ENTRAINED FLOW GASIFICATION

(71) Applicant: SIEMENS AKTIENGESELLSCHAFT, München (DE)

(72) Inventors: Frank Hannemann, Freiberg (DE); Manfred Schingnitz, Freiberg (DE); Heidrun Toth, Freiberg (DE)

(73) Assignee: SIEMENS AKTIENGESELLSCHAFT (DE)

( * ) Notice: Subject to any disclaimer, the term of this patent is extended or adjusted under 35 U.S.C. 154(b) by 16 days.

(21) Appl. No.: 14/612,371

(22) Filed: Feb. 3, 2015

(65) Prior Publication Data

US 2015/0218471 A1 Aug. 6, 2015

(30) Foreign Application Priority Data

Feb. 3, 2014 (DE) ..... 10 2014 201 890

(51) Int. Cl.
*C10J 3/84* (2006.01)
*C10J 3/48* (2006.01)

(52) U.S. Cl.
CPC ..... *C10J 3/84* (2013.01); *C10J 3/485* (2013.01); *C10J 3/845* (2013.01); *C10J 2200/152* (2013.01)

(58) Field of Classification Search
CPC combination set(s) only.
See application file for complete search history.

(56) References Cited

U.S. PATENT DOCUMENTS 2,931,715 A * 4/1960 Eastman ..... C10J 3/485 48/206
4,326,856 A * 4/1982 Muenger ..... B01D 45/08 252/373

(Continued)

FOREIGN PATENT DOCUMENTS

CN 101003754 7/2007
CN 101675146 A 3/2010

(Continued)

OTHER PUBLICATIONS

Schmalfeld J. et al: Die Veredlung und Umwandlung von Kohle, Technologien und Projekte 1970 bis 2000 in Deutschland, Deutsche Wissenschaftliche Gesellschaft für Erdöl, Erdgas und Kohle e.V., Kapitel 4.4.2 Gaskombinat Schwarze-Pumpe-Verfahren (GSP) und Kapitel 4.4.3 Shell-Kohlenvergasungsverfahren, pp. 537-558, Dec. 2008; 2008; (with English translation).

(Continued)

*Primary Examiner* — Kaity Handal
(74) *Attorney, Agent, or Firm* — Ostrolenk Faber LLP

(57) ABSTRACT

An apparatus for a three-stage cooling and scrubbing system for the treatment of hot crude gases and liquid slag downstream of an entrained flow gasification. Crude gas and slag are firstly cooled and prescrubbed in a first stage by injection of water from ring and/or wall nozzles into a free quench space. Crude gas and slag are then fed together with excess water into a waterbath as a second stage before intensive spraying is once again carried out as a third cooling and scrubbing stage in an annular space.

8 Claims, 2 Drawing Sheets

(56) References Cited

U.S. PATENT DOCUMENTS 4,328,006 A * 5/1982 Muenger ..... B01D 45/08 122/5
4,377,132 A * 3/1983 Koog ..... C10J 3/86 122/7 R
4,377,394 A * 3/1983 Muenger ..... B01D 45/08 122/5
4,466,808 A * 8/1984 Koog ..... C10J 3/485 252/373
4,474,584 A * 10/1984 Koog ..... C10J 3/485 252/373
4,494,963 A * 1/1985 Reich ..... C10J 3/485 48/69
4,520,760 A * 6/1985 Covell ..... C10J 3/76 122/6 A
4,605,423 A * 8/1986 Koog ..... C10J 3/485 48/69
4,768,470 A * 9/1988 Ziegler ..... C10J 3/86 122/32
4,778,483 A * 10/1988 Martin ..... B01D 47/024 48/69
4,852,997 A * 8/1989 Segerstrom ..... C10J 3/526 48/210
5,324,336 A 6/1994 Child
5,968,212 A * 10/1999 Peise ..... C10J 3/08 110/346
5,976,203 A * 11/1999 Deeke ..... C10J 3/485 422/207
7,090,707 B1 * 8/2006 Barot ..... C10J 3/485 48/113
8,187,349 B2 5/2012 Jancker et al.
8,240,259 B2 8/2012 Fischer et al.
8,770,555 B2 7/2014 Schulze et al.
8,986,403 B2 3/2015 Klockow et al.
2007/0044381 A1 3/2007 Holle et al.
2008/0222955 A1 * 9/2008 Jancker ..... C10J 3/06 48/67
2009/0126259 A1 * 5/2009 Den Berg ..... C01B 3/12 44/300
2010/0139581 A1 6/2010 Ebner
2010/0143216 A1 * 6/2010 Ten Bosch ..... C10J 3/485 422/207

FOREIGN PATENT DOCUMENTS

CN 101935554 A 1/2011
CN 102239235 A 11/2011
CN 102382685 A 3/2012
DE 145 860 A3 1/1981
DE 224 045 A1 6/1985
DE 265 051 A3 2/1989
DE 44 46 803 6/1996
DE 197 18 131 A1 11/1998
DE 199 52 754 5/2001
DE 10 2005 047 930 A1 4/2007
DE 10 2006 031816 A1 1/2008
DE 10 2007 042543 A1 3/2009
EP 0 677 567 10/1995

OTHER PUBLICATIONS

First Office Action with Search Report dated Sep. 5, 2016 in corresponding Chinese Patent Application No. 201510054990.1 (with English language translation)(total 19 pages).

* cited by examiner

COOLING AND SCRUBBING OF A CRUDE GAS FROM ENTRAINED FLOW GASIFICATION

CROSS-REFERENCE TO RELATED APPLICATIONS

The present application claims priority of German Patent Application No. 102014201890.0, filed Feb. 3, 2014, the contents of which are incorporated by reference herein.

FIELD OF THE INVENTION

The invention relates to an apparatus of a combined quenching and scrubbing system for the cooling and purification of crude gases from an entrained flow gasification plant in which fuel dusts are reacted with oxygen and moderated by such as steam or else carbon dioxide at temperatures of 1200-1900° C. and pressures of up to 10 MPa to give a CO- and $H_2$-rich crude gas.

BACKGROUND OF THE INVENTION

For the purposes of the present invention, fuel dusts are finely milled coals having different degrees of carbonization, dusts composed of biomasses, products of thermal pretreatment, e.g. coke, dried products obtained by "torrefaction" and also calorific fractions from domestic and industrial residues and wastes. The fuel dusts can be fed as a gas-solid or liquid-solid suspension to the gasification. The gasification reactors can be provided with a cooling shield or with a refractory lining, as disclosed in the patents DE 4446803 and EP 0677567. In various systems which have been introduced into industry, crude gas and the molten slag can be discharged separately or together from the reaction space of the gasification apparatus, as described in DE 19718131.

Owing to the fuel particles which have been milled to dust fineness and short reaction times in the gasification space, entrained flow gasification results in an increased proportion of dust in the crude gas. This fly dust consists, depending on the reactivity of the fuel, of soot, and reacted fuel particles and also fine slag and ash particles. The size varies from coarse particles having diameters of greater than 0.5 mm to fine particles having a diameter of up to 0.1 The ease with which the particles can be separated from the crude gas is dependent on this diameter but also on the composition of the particles. A distinction can basically be made between soot and ash or slag particles, with soot particles generally being smaller and more difficult to separate from the crude gas. Slag particles have a higher density and are thus easier to separate off, but have a greater hardness and erosive effect. This leads to increased wear in the lines conveying the crude gas and can result in safety-relevant leaks and decreases in the life of these plant components. Various scrubbing systems are used for removing the dusts resulting from the fuels.

Prior art is summarized in the patent document DE 10 2005 041 930 and in "Die Veredelung and Umwandlung von Kohle" DGMK, Hamburg, December 2008, Schingnitz, chapter "GSP-Verfahren". According to this, the crude gasification gas together with the slag formed from the fuel ash leaves the gasification space at temperatures of 1200-1900° C. and is cooled in a downstream quenching space by spraying in excess water and is freed of the slag and to a small extent of entrained dust, with the quenching space being able to be configured as a free-space quencher or be equipped with a central tube conveying crude gas. A free-space quenching system is disclosed, for example, in DE 10 2007 042543, in which the crude gas leaving the gasification space is sprayed with water and taken off in the lower part under a roof construction. DE 10 2006 031816 discloses a free quenching space completely without internals, with quenching water being injected at one or more levels in such an amount that the crude gas is cooled and saturated with water vapor and the excess quenching water is taken off either alone or together with precipitated slag in the lower part. Variants having a central tube are disclosed in the patent DE 199 52 754, in which the central tube is configured in the form of a Venturi tube, DD 145860, in which the crude gas is subjected to an additional scrub in the form of an airlift pump, and DD 265051, in which elements for distributing the exiting crude gas at the end of the central tube are supposed to ensure uniform outflow. CN 101003754-B describes an immersion quenching apparatus having a central tube in which the hot crude gas from the gasification reactor is conveyed together with the likewise hot slag downward into water beneath the surface thereof and flows upward as gas-water suspension in the annular gap of the guide tube configured as a double tube. Gas-water separation occurs at the upper end of the guide tube. The gas-water suspension flowing upward in the annular gap is said to protect the inner central tube against overheating.

The solution to the problem proposed in the patent DE 10 2007 042 543 has the disadvantage that the free space through pipes having a relatively large diameter for discharging the crude gas and the roof construction provides deposition surfaces for entrained slags and dusts, which experience has shown leads to blockages. DE 10 2006 031816 requires uniform outflow of the hot crude gas from the gasification space because otherwise there could be a risk of thermal overloading of the pressure-rated vessel walls. The installation of a Venturi tube as described in DE 199 52 754 can lead to undesirable pressure fluctuations in the gasification space which are difficult to equalize by regulation technology because of their brief duration. Internals in the quenching and scrubbing space, as described in the patents DD 265051 and DD 145860, can lead to cement-like products due to the pozzolanic properties of, in particular, the fine dust components in the case of particular types of coal and ash and these likewise lead to blockages and an increase in the pressure drop. This risk is likewise present in the case of the problem solution proposed in CN 101003754-B. The gap between the inner and outer tubes of the central tube can become blocked, and the hot crude gas flowing downward in the uncooled inner tube can lead to thermal destruction of the inner tube and additionally endangers the pressure wall of the quenching space by overheating.

SUMMARY OF THE INVENTION

It is an object of the invention to provide an apparatus for cooling the hot gasification gas and the entrained liquid slag, in which, firstly, cooling of the hot crude gas down to the temperature of water vapor saturation determined by the process pressure and, secondly, simultaneous deposition of slag and dust and also a high proportion of hydrogen in the crude gas are achieved.

According to the invention, a plurality of first cooling and scrubbing stages connected in series are combined with one another. The hot crude gasification gas leaves the gasification reactor together with the liquid slag formed from the fuel ash via a specific outflow device and goes into a free-space quencher as first stage. Cooling down to the process pressure-dependent saturation temperature and first coarse separation of dust are achieved by injection of cooling and scrubbing water into the hot gas stream via a nozzle ring 13 directly on the outflow device. The amount of water injected is such that the subsequent components are sufficiently wetted. The free-space quench is terminated at the bottom by a funnel-shaped insert 9 which guides the precooled crude gas and the slag via a tubular extension into a waterbath 7 as a second treatment stage. While relatively coarse slag particles separate off in a downward direction, fine dust is bound in the waterbath through which the crude gas flows in the manner of a bubble column. The crude gas leaving the bubble column is, before leaving the cooling and scrubbing apparatus, once again treated with scrubbing water via a nozzle ring 5 as a third stage in order to retain as much fine dust as possible. As a result of the combination of the cooling and scrubbings connected in series and the conversion reaction between carbon monoxide and water vapor proceeding during cooling of the crude gas by means of water, a high proportion of hydrogen in the crude gas is achieved. The cooled and scrubbed water vapor-saturated crude gas is subsequently passed to further external treatment stages.

To protect the pressure wall 3 against overheating, particularly in the region of the free-space quench, an inner water wall 10 can be provided. Furthermore, it is possible to convey the crude gas into the bubble column through a guide ring 17.

The invention is illustrated below by means of an example with the aid of two figures. The figures show:

DESCRIPTION OF EMBODIMENTS

Figure 1:
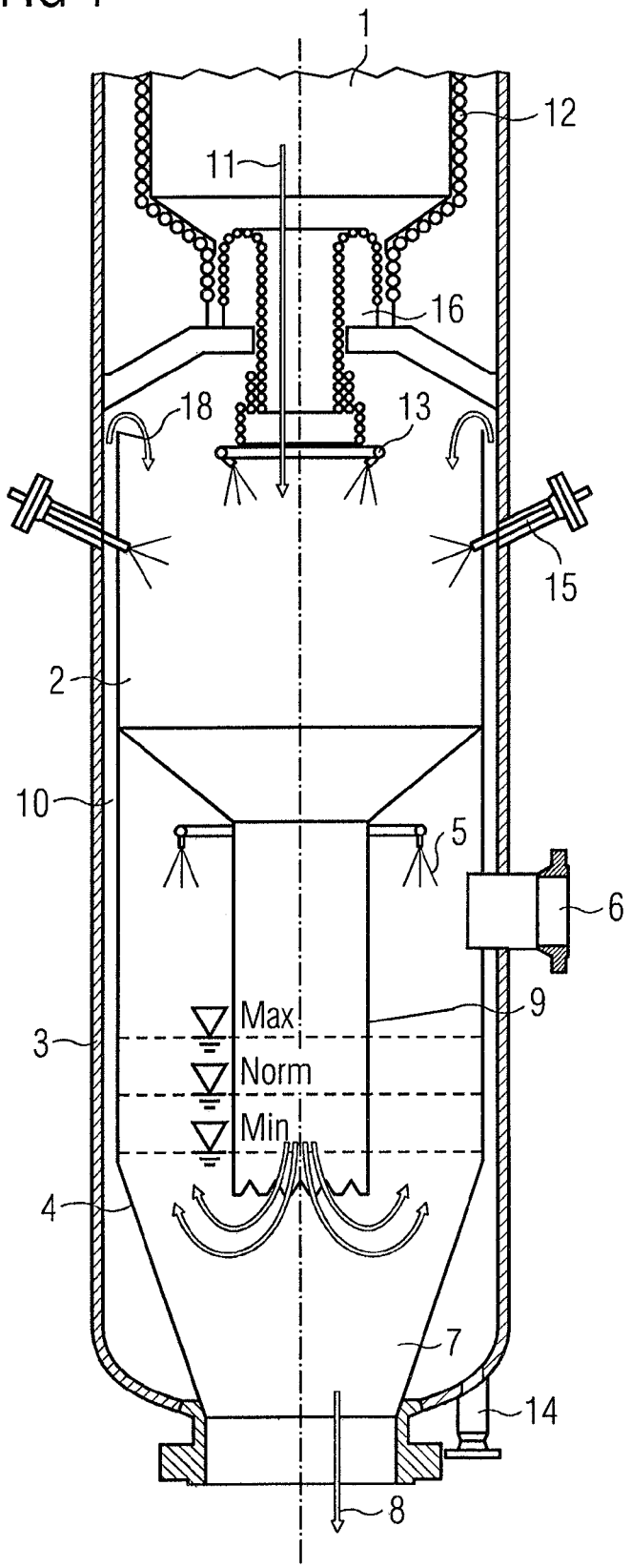
FIG. 1 a cooling and scrubbing system according to the invention, with the figure being depicted as a section through a rotationally symmetric system, and FIG. 2 a cooling and scrubbing system having an additional guide device 17 for the bubble column stage 2.

In the Figures, identical reference numerals denote identical elements.

In a gasification reactor 1 as per FIG. 1, in a reaction space delimited by a cooling shield 12, 68 t/h of coal dust are converted, at a net power output of 500 MW, with addition of an oxygen-containing gasification agent and of steam, into crude gas and liquid slag by autothermal partial oxidation at an operating pressure of 4.2 MPa. The amount of moist crude gas produced of 145 000 $m^3$ (STP)/h and the 4.7 Mg/h of liquid slag 11 formed from the fuel ash flow together at temperatures of 1400-1800° C. through the gas and slag outlet 16 into the first stage configured as free-space quencher 2 of the cooling and scrubbing system. Cooling and scrubbing water is injected into the crude gas and slag stream 11 directly downstream of the gas and slag outlet 16 via a nozzle ring 13 in order to cool the crude gas to the saturation temperature determined by the pressure and ensure wetting of the subsequent components. In addition to the nozzle ring 13, further cooling and scrubbing water can be introduced through nozzles 15 passed through the pressure wall 3. The inlets 13 and 15 can be operated either alone or together. Precooled crude gas, slag and excess water are conveyed through the funnel 9 into the waterbath 7 in which the slag settles out and is removed in a downward direction via the outlet 8. The funnel 9 dips into the waterbath 7, and guides the crude gas into the waterbath 7 so as to form an ascending gas-scrubbing water suspension, in a manner similar to a bubble column having a good scrubbing effect as second scrubbing stage of the cooling and scrubbing process. After leaving the waterbath 7, the crude gas is treated further with scrubbing water in a superposed free space via a nozzle ring 5 as third scrubbing stage in order to remove further dust particles from the crude gas. The cooled and scrubbed crude gas leaves the three-stage cooling and scrubbing system via the gas outlet 6 at a pressure of 4.1 MPa and a temperature of 225° C. and is passed for further treatment. To protect the pressure wall 3, a water wall 10 which is supplied with pure water via the inlet 14 is formed on the inner wall 4 and at the upper end 18 of the inner wall 4 flows over into the free-space quencher 2.

Figure 2:
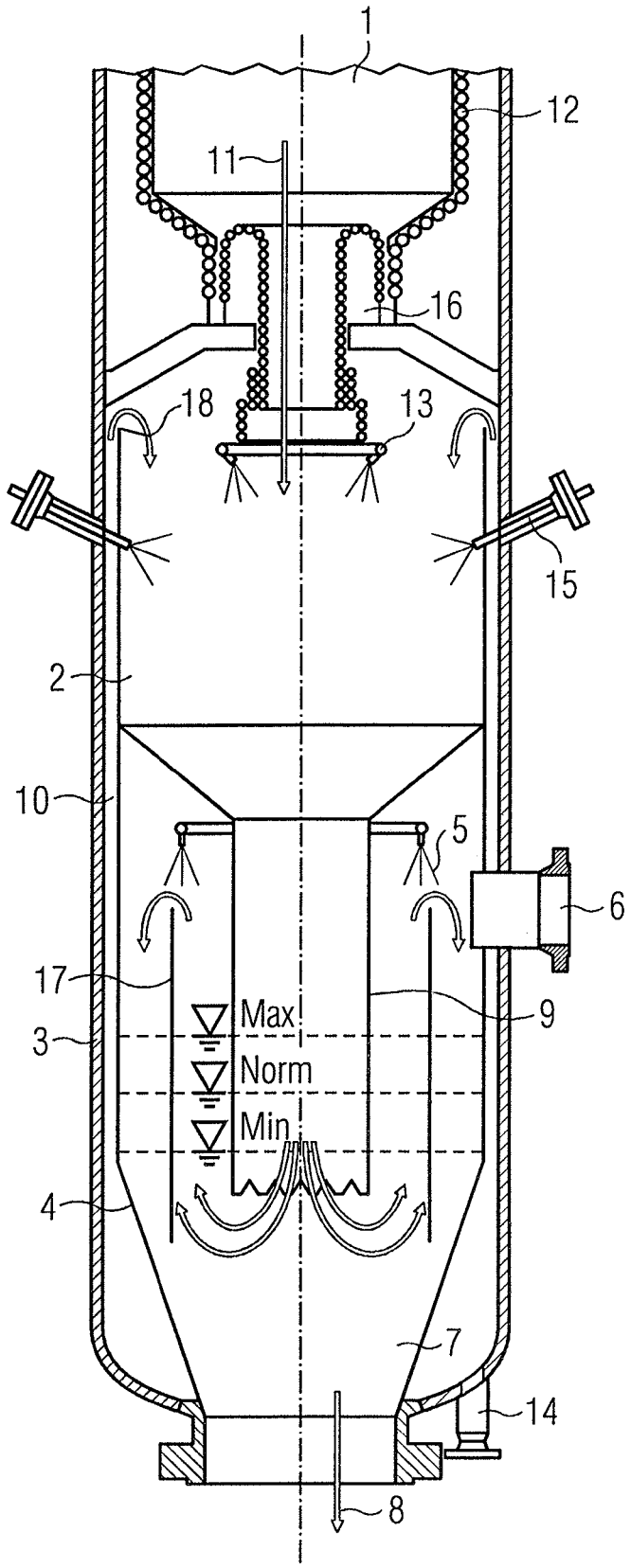

In a particular embodiment in FIG. 2, the bubble column in the water bath 7 can be configured by means of an inner ring 17 in such a way that the crude gas has to complete another change in direction before the nozzle ring 5.

The apparatus of the invention also makes it possible to perform a process in which

- the crude gas which has a temperature of 1200-1800° C. and is under a pressure of up to 10 MPa is conveyed together with the liquid slag from a gasification reactor 1 delimited by a cooling shield 12 via a crude gas and slag outlet 16 into a three-stage cooling and scrubbing apparatus,
- cooling and scrubbing water are injected into a free-space quench 2 as a first cooling and scrubbing stage,
- the precooled crude gas and the slag from the free-space quench 2 are conveyed via a funnel 9 into a waterbath as a second cooling and scrubbing stage in which the ascending crude gas forms a gas-water suspension with the waterbath 7 in a manner similar to a bubble column,
- after leaving the bubble column, the crude gas is subjected in a superposed free space as a third cooling and scrubbing stage to another intensive free-space scrub by means of a nozzle ring 5 and the temperature of water vapor saturation determined by the process pressure is attained and
- the cooled and scrubbed crude gas is passed via the gas outlet 6 to further treatment stages in order to produce a pure gas.

In an apparatus in which an inner wall 4 is arranged in the quencher, the annular gap 10 between the pressure wall 3 and the inner wall 4 is, in an inventive embodiment of the invention, continuously flushed with water.

In an apparatus in which an inner wall 4 is arranged in the quencher and in which the annular gap 10 between the pressure wall 3 and the inner wall 4 is continuously flushed with water, the water leaving the annular gap 4 as a water wall runs down as a water film on the inside of the inner wall 4.

In an apparatus in which an inner ring 17 is arranged in the free space, the bubble column in the waterbath 7 is, in an inventive embodiment of the process, kept away from the inner wall 4 by the inner ring 17, with the crude gas experiencing another change in direction at the upper end of the inner ring 17.

LIST OF REFERENCE NUMERALS

1 Gasification reactor
2 Free-space quench
3 Pressure wall
4 Inner wall
5 Nozzle ring
6 Gas outlet

7 Waterbath
8 Slag outlet
9 Funnel
10 Annular gap as water wall
11 Crude gas, slag
12 Cooling shield
13 Nozzle ring
14 Pure water inlet
15 Nozzles on pressure wall
16 Gas and slag outlet
17 Inner ring, inner tube, guide device,
18 Upper end of the inner wall

The invention claimed is:

1. An apparatus for treating hot crude gases and liquid slag having temperatures of 1200-1800° C. and pressures of up to 10 MPa in an entrained flow gasification of fuel dust, the apparatus comprising a gasification reactor, a quencher, a crude gas and slug outlet, a crude gas outlet, a funnel, first nozzles, and second nozzles, wherein the quencher is arranged downstream of the gasification reactor, and the quencher and the gasification reactor are surrounded by a pressure wall;

the crude gas and slag outlet connects the gasification reactor to the quencher;

the quencher has an inner wall spaced inward of the pressure wall;

a waterbath is located in a lower part of the quencher;

a free space quench is located in the quencher in flow succession after the crude gas and slag outlet, the free space quench having the first nozzles located and configured for injecting cooling and scrubbing water into the free space quench;

the funnel is located in the quencher inside the inner wall and downstream of the free-space quench;

the funnel has an upper end in contact with the inner wall of the quencher and has an open lower end dipping into the waterbath;

an annular space is formed between the funnel, a surface of the waterbath, and the inner wall of the quencher;

the crude gas outlet is connected to the annular space for the flow of crude gas that has passed downward through the funnel, downward through the waterbath, upward through the waterbath, and upward through the annular space, the flow of crude gas flowing through the crude gas outlet outside of the pressure wall;

the second nozzles are configured and located above the surface of the waterbath for injecting cooling and scrubbing water, the second nozzles being arranged inside the annular space; and the inner wall bounds the free space quench in the radial direction with respect to the central longitudinal axis of the quencher.

2. The apparatus as claimed in claim 1, further comprising a water wall is located between the pressure wall and the inner wall and below the funnel upper end where it is in contact with the inner wall.

3. The apparatus as claimed in claim 1, wherein the first nozzles are arranged on the inner wall of the quencher and have outlets inward of the inner wall.

4. The apparatus as claimed in claim 3, wherein the first nozzles are supported directly on the pressure wall.

5. The apparatus as claimed in claim 1, further comprising third nozzles located and configured for injecting cooling and scrubbing water in the free space quench and wherein the third nozzles tightly surround the crude gas and slag outlet.

6. The apparatus as claimed in claim 5, wherein the third nozzles are arranged in a nozzle ring arranged directly at the crude gas and slag outlet in the free-space quench.

7. The apparatus as claimed in claim 1, further comprising an inner tube having a lower end that dips into the waterbath and wherein the inner tube is arranged below the second nozzles.

8. The apparatus as claimed in claim 1, further comprising a cooling shield delimiting the gasification reactor of the apparatus.

* * * * *